US011530107B2

(12) United States Patent
Sugiyama et al.

(10) Patent No.: US 11,530,107 B2
(45) Date of Patent: Dec. 20, 2022

(54) SHEET PROCESSING APPARATUS AND IMAGE FORMING SYSTEM INCORPORATING THE SHEET PROCESSING APPARATUS

(71) Applicants: Keisuke Sugiyama, Kanagawa (JP); Tomohiro Furuhashi, Kanagawa (JP)

(72) Inventors: Keisuke Sugiyama, Kanagawa (JP); Tomohiro Furuhashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/938,091

(22) Filed: Jul. 24, 2020

(65) Prior Publication Data

US 2021/0039916 A1 Feb. 11, 2021

(30) Foreign Application Priority Data

Aug. 9, 2019 (JP) ..... JP2019-148121

(51) Int. Cl.
*B65H 35/00* (2006.01)
*B41J 11/66* (2006.01)

(52) U.S. Cl.
CPC ..... *B65H 35/0006* (2013.01); *B41J 11/666* (2013.01); *B65H 35/0086* (2013.01); *B65H 2301/515123* (2013.01)

(58) Field of Classification Search
CPC ..... Y10T 83/49; B65H 2301/515123; B65H 2601/522; B41J 11/666; B41J 1/666
See application file for complete search history.

(56) References Cited

U.S. PATENT DOCUMENTS 3,735,660 A * 5/1973 Pearl ..... B26F 1/382 83/560
4,467,525 A * 8/1984 Logan ..... B43L 13/026 33/18.2

(Continued)

FOREIGN PATENT DOCUMENTS

AU 2002353179 A1 * 7/2003 ..... B43L 13/206
CN 103372875 A 10/2013

(Continued)

OTHER PUBLICATIONS

Extended European Search Report dated Feb. 8, 2021 issued in corresponding European Appln. No. 20188301.4.

(Continued)

*Primary Examiner* — Jennifer Bahls
(74) *Attorney, Agent, or Firm* — Harness, Dickey & Pierce, P.L.C.

(57) ABSTRACT

A sheet processing apparatus includes a sheet conveyor configured to convey a sheet, a processing tool configured to perform processing to the sheet, a tool contact separation device, a tool moving device, and a tool facing device. The tool contact separation device is configured to contact and separate the processing tool to the sheet. The tool moving device is configured to move the processing tool in a direction intersecting a conveyance direction of the sheet. The tool facing device has an opposing face and is disposed at a position at which the tool facing portion faces the processing tool via the sheet. The tool facing device is configured to move to change the tool facing portion in accordance with a relative moving direction of the sheet with respect to the processing tool when the processing tool performs the processing to the sheet.

15 Claims, 10 Drawing Sheets

(56) References Cited

U.S. PATENT DOCUMENTS

| | | | | |
|---|---|---|---|---|
| 5,868,507 | A * | 2/1999 | Thomas | B26D 7/00 400/616 |
| 6,190,297 | B1 * | 2/2001 | Croft | B31F 1/08 493/59 |
| 6,506,324 | B1 * | 1/2003 | Gerber | B29C 59/026 264/40.1 |
| 2004/0085422 | A1 * | 5/2004 | Kelley | B41J 11/66 347/101 |
| 2005/0223865 | A1 | 10/2005 | Hennes | |
| 2008/0217837 | A1 | 9/2008 | Nagasako et al. | |
| 2008/0224386 | A1 | 9/2008 | Kunieda et al. | |
| 2009/0206547 | A1 | 8/2009 | Tokita et al. | |
| 2011/0248440 | A1 | 10/2011 | Sugiyama et al. | |
| 2013/0266358 | A1 * | 10/2013 | Nowak | B26D 5/34 400/621 |
| 2013/0269495 | A1 | 10/2013 | Clark et al. | |
| 2014/0116218 | A1 * | 5/2014 | Kwarta | B26D 9/00 83/425.4 |
| 2014/0151949 | A1 | 6/2014 | Hoshino | |

FOREIGN PATENT DOCUMENTS

| | | | |
|---|---|---|---|
| CN | 109300682 | A | 2/2019 |
| CN | 208629501 | U | 3/2019 |
| JP | 2000-272823 | | 10/2000 |
| JP | 2002-346982 | | 12/2002 |
| JP | 2004-114198 | | 4/2004 |
| JP | 2005-007721 | | 1/2005 |
| JP | 2012-016751 | | 1/2012 |
| JP | 2013-103311 | | 5/2013 |
| JP | 2014-176958 | | 9/2014 |

OTHER PUBLICATIONS

Chinese Office Action dated Mar. 22, 2022 for CN Application No. 202010777131.6.

* cited by examiner

SHEET PROCESSING APPARATUS AND IMAGE FORMING SYSTEM INCORPORATING THE SHEET PROCESSING APPARATUS

CROSS-REFERENCE TO RELATED APPLICATION

This patent application is based on and claims priority pursuant to 35 U.S.C. § 119(a) to Japanese Patent Application No. 2019-148121, filed on Aug. 9, 2019, in the Japan Patent Office, the entire disclosure of which is hereby incorporated by reference herein.

BACKGROUND

Technical Field

This disclosure relates to a sheet processing apparatus and an image forming system incorporating the sheet processing apparatus.

Background Art

Various types of sheet processing apparatuses are known to perform a cut process and a crease process to a sheet. Such a sheet processing apparatus is used to create the processing patterns of stickers, cards, or box-shaped 3D objects, from a sheet on which an image or design pattern is printed.

It is known there are various types of sheet processing apparatuses. For example, a flatbed type sheet processing apparatus fixes a sheet on a table provided on the apparatus, and causes a cutter tool and a creasing tool, which are processing tools, to selectively contact with pressure to the sheet or separate from the sheet while moving the cutter tool and the creasing tool over the sheet in a two-dimensional area. By so doing, a two-dimensional processing is provided to the sheet along a given trajectory while the sheet is fixed on the surface of the table.

On the other hand, a conveyance type sheet processing apparatus is provided with a pair of sheet conveying rollers to convey a sheet in a given direction, in addition to the same processing tools as the processing tools provided in the flatbed type sheet processing apparatus. The conveyance type sheet processing apparatus moves the processing tools in a direction orthogonal to the conveyance direction of the sheet while conveying the sheet. By relatively conveying the sheet and moving the processing tool, the conveying type sheet processing apparatus causes the processing tool to selectively contact the sheet with pressure or separate from the sheet. By so doing, the processing tool performs the processing in the two-dimensional area along a given trajectory of the processing tool to the sheet.

Since the conveyance type sheet processing apparatus does not include a table having a surface larger than a sheet, the conveyance type sheet processing apparatus is more preferable to enhance a reduction in size of the sheet processing apparatus. However, instead of the table having the surface larger than a sheet, the conveyance type sheet processing apparatus may need to include a facing member to face the processing tool, so that the facing member functions as a receiving member to prevent deformation of the sheet due to contact and application of pressure of the cutter tool and the creasing tool to the sheet. The facing member includes an elastic member such as a cutter mat. Note that, in a case in which the facing member is disposed facing the cutter tool, a fine groove shape member that meshes with the cutter blade may be used instead of the cutter mat.

SUMMARY

At least one aspect of this disclosure, a novel sheet processing apparatus includes a sheet conveyor, a processing tool, a tool contact separation device, a tool moving device, and a tool facing device. The sheet conveyor is configured to convey a sheet. The processing tool is configured to perform processing to the sheet. The tool contact separation device is configured to contact and separate the processing tool to the sheet. The tool moving device is configured to move the processing tool in a direction intersecting a conveyance direction of the sheet. The tool facing device includes a tool facing portion disposed at a position facing the processing tool via the sheet. The tool facing device is configured to move to change the tool facing portion in accordance with a relative moving direction of the sheet with respect to the processing tool when the processing tool performs the processing to the sheet.

Further, at least one aspect of this disclosure, an image forming system includes an image forming apparatus configured to form an image on a sheet, and the above-described sheet processing apparatus configured to process the sheet with the image formed by the image forming apparatus.

BRIEF DESCRIPTION OF THE SEVERAL VIEWS OF THE DRAWINGS

Exemplary embodiments of this disclosure will be described in detail based on the following figures, wherein.

Figure 1:
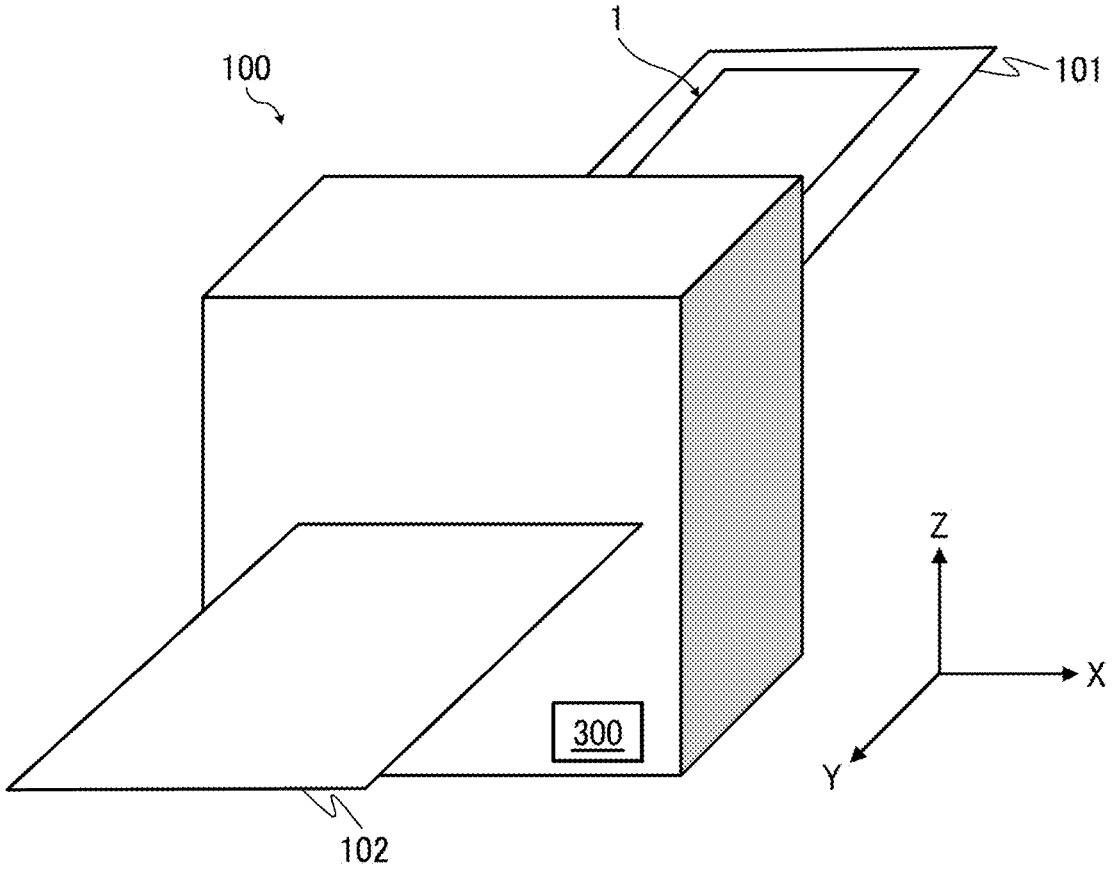
FIG. 1 is a perspective view illustrating a sheet processing apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to"

another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Overall Configuration of Sheet Processing Apparatus.

Hereinafter, embodiments of a sheet processing apparatus according to the present embodiment is described with reference to the drawings.

FIG. 1 is a perspective view illustrating the external appearance of a sheet processing apparatus 100 according to an embodiment of this disclosure. As illustrated in FIG. 1, the sheet processing apparatus 100 includes a sheet receiver tray 101 and a sheet transfer tray 102. The sheet receiver tray 101 functions as a sheet receiving port via which a sheet 1 that functions as a sheet-like processing target member and a sheet member is conveyed to the sheet processing apparatus 100. The sheet transfer tray 102 functions as a sheet transfer port of the processed sheet 1 after processing. The sheet 1 is processed while being conveyed in a direction indicated by arrow Y (Y direction) in FIG. 1.

Note that, as illustrated in FIG. 1, the sheet processing apparatus 100 further includes a control device 300 that controls the whole operations of the sheet processing apparatus 100.

Here, coordinate systems used to describe the present embodiment are defined.

A Y direction is a direction in which the sheet 1 before processing is conveyed to the sheet processing apparatus 100 and the sheet 1 after processing is conveyed from the sheet processing apparatus 100. An X direction is a direction that intersects the Y direction and corresponds to the width direction of the sheet 1 (the width direction of the sheet processing apparatus 100). A Z direction is a direction that intersects the Y direction and the X direction and corresponds to the direction of height of the sheet processing apparatus 100. Note that the embodiment is explained with an example in which the X direction, the Y direction, and the Z direction are orthogonal to each other. Accordingly, the phrase "conveyance direction of the sheet 1" in the present embodiment corresponds to movement of the sheet 1 in the Y direction.

Figure 2:
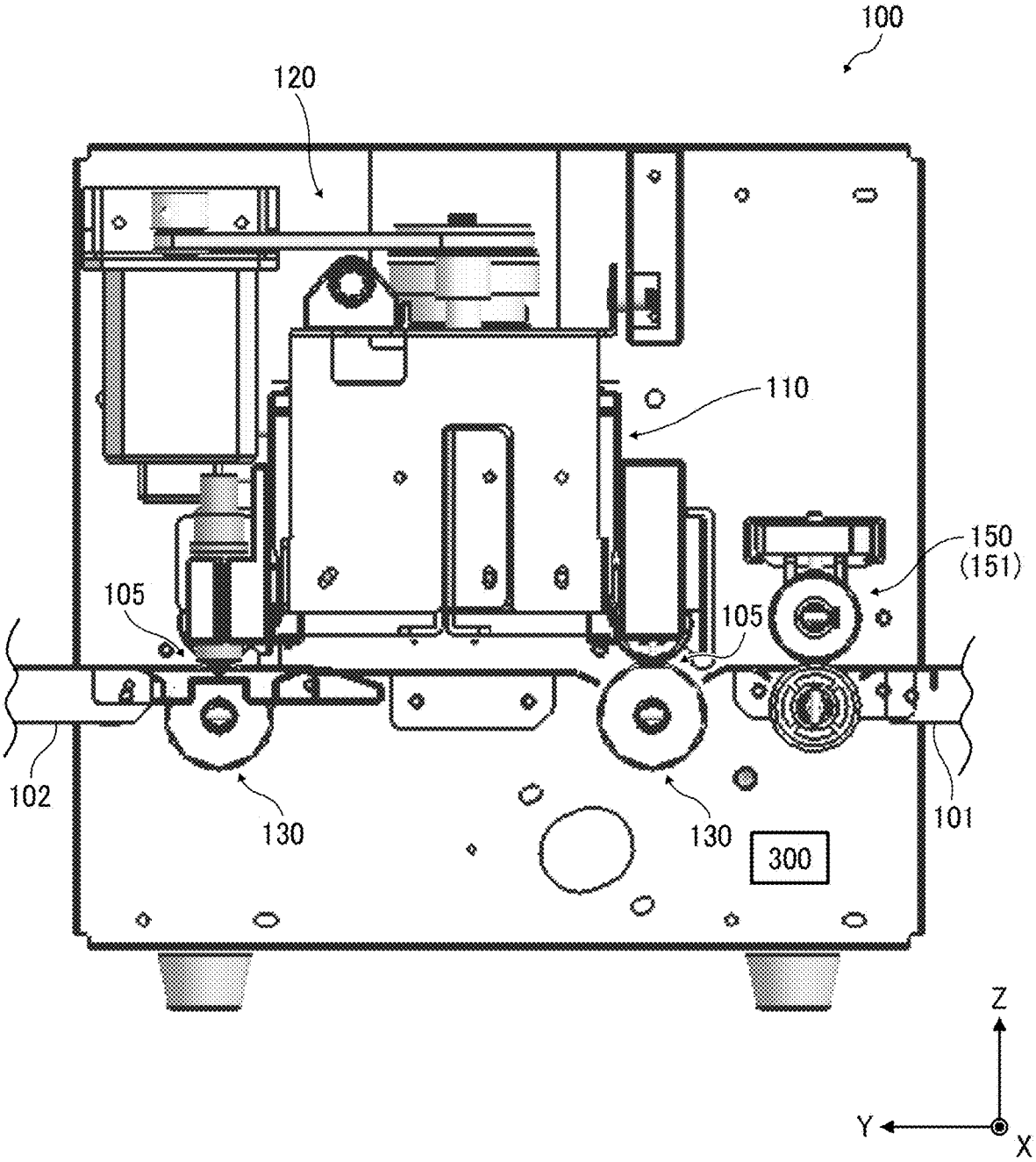
FIG. 2 is a cross-sectional view illustrating the sheet processing apparatus.

FIG. 2 is a cross-sectional view illustrating the internal configuration of the sheet processing apparatus 100. FIG. 2 is the cross-sectional view of a plane Y-Z of the sheet processing apparatus 100 in FIG. 1.

As illustrated in FIG. 2, the sheet processing apparatus 100 includes processing tools 105, a tool contact separation device 110, a tool moving device 120, and a tool facing device 130. The sheet processing apparatus 100 further includes pairs of conveyance rollers 150 that function as a sheet conveyor or conveyance members to reciprocally convey the sheet 1 toward the processing tools 105. The pairs of conveyance rollers 150 include a first pair of conveyance rollers 151 and a second pair of conveyance rollers 152. In FIG. 2, the first pair of conveyance rollers 151 alone is depicted from the pairs of conveyance rollers 150. The first pair of conveyance rollers 151 is disposed on the sheet receiving port side.

The processing tools 105 are held by the tool contact separation device 110 so that the processing tools 105 are disposed at respective positions facing the tool facing device 130 with the sheet 1 interposed between the processing tools 105 and the tool facing devices 130.

The tool contact separation device 110 holds the processing tools 105 such as a cutter tool to perform a cut process to the sheet 1 and a creasing tool to perform a crease process to the sheet 1. Details of the processing tools 105 are described below. The tool contact separation device 110 includes a tool moving mechanism for contact and separation of the processing tools to cause the processing tools 105 to contact to or separate from the sheet 1.

The tool moving device 120 includes a tool moving mechanism for sheet processing (tool moving mechanism for contact and separation of the processing tools) to reciprocally move the processing tools 105 in the X direction when the sheet processing such as the cut process and the crease process is performed to the sheet 1. Note that, in the present embodiment, the X direction is a direction orthogonal to the Y direction that is the conveyance direction of the sheet 1, in other words, an orthogonal direction to the Y direction (the conveyance direction of the sheet 1). Note that the direction of height of the sheet processing apparatus 100 is defined as the Z direction as illustrated in FIGS. 1 and 2. Therefore, the X direction is the direction orthogonal to the conveyance direction of the sheet 1 and the direction of height of the sheet processing apparatus 100 and corresponds to the width direction of the sheet 1.

The tool facing device 130 includes rollers that function as rotary members. The rollers include respective tool opposing faces (tool facing portions) disposed facing the processing tools 105. Each tool opposing face corresponds to a position to receive pressing force to the sheet 1 applied by the processing tool 105 corresponding to a process position at which the processing tool 105 contacts the sheet 1 when the processing tool 105 moves in the X direction in the sheet processing. In other words, the tool opposing face is located at a position at which the tool opposing face of the tool facing device 130 faces the processing tool 105 via the sheet 1 interposed between the tool facing device 130 and the processing tool 105. As illustrated in FIG. 2, the tool opposing face of the tool facing device 130 corresponds to the same position as the processing tool 105 in the Y direction. In other words, the tool opposing face of the tool facing device 130 is disposed below the processing tool 105 in the vertical direction (the Z direction). Further, in other words, the processing tool 105 is disposed above the tool opposing face in the vertical direction (the Z direction) and is held not to move (that is, held to be immovable) in the Y direction.

The sheet processing apparatus 100 performs the sheet processing by the processing tools 105 while the sheet 1 is conveyed in the Y direction. In the sheet processing, the processing tools 105 and the tool contact separation device 110 move not in the Y direction to the tool facing device 130 but in the X direction to the tool facing device 130. While the processing tools 105 and the tool contact separation device 110 move in the X direction, the processing tools 105 selectively contact to or separate from the sheet 1. With the above-described operation, the sheet processing apparatus 100 performs sheet processing while drawing a trajectory including given plane free curves on the sheet 1.

Configuration of Main Part of the Sheet Processing Apparatus 100.

Figure 3:
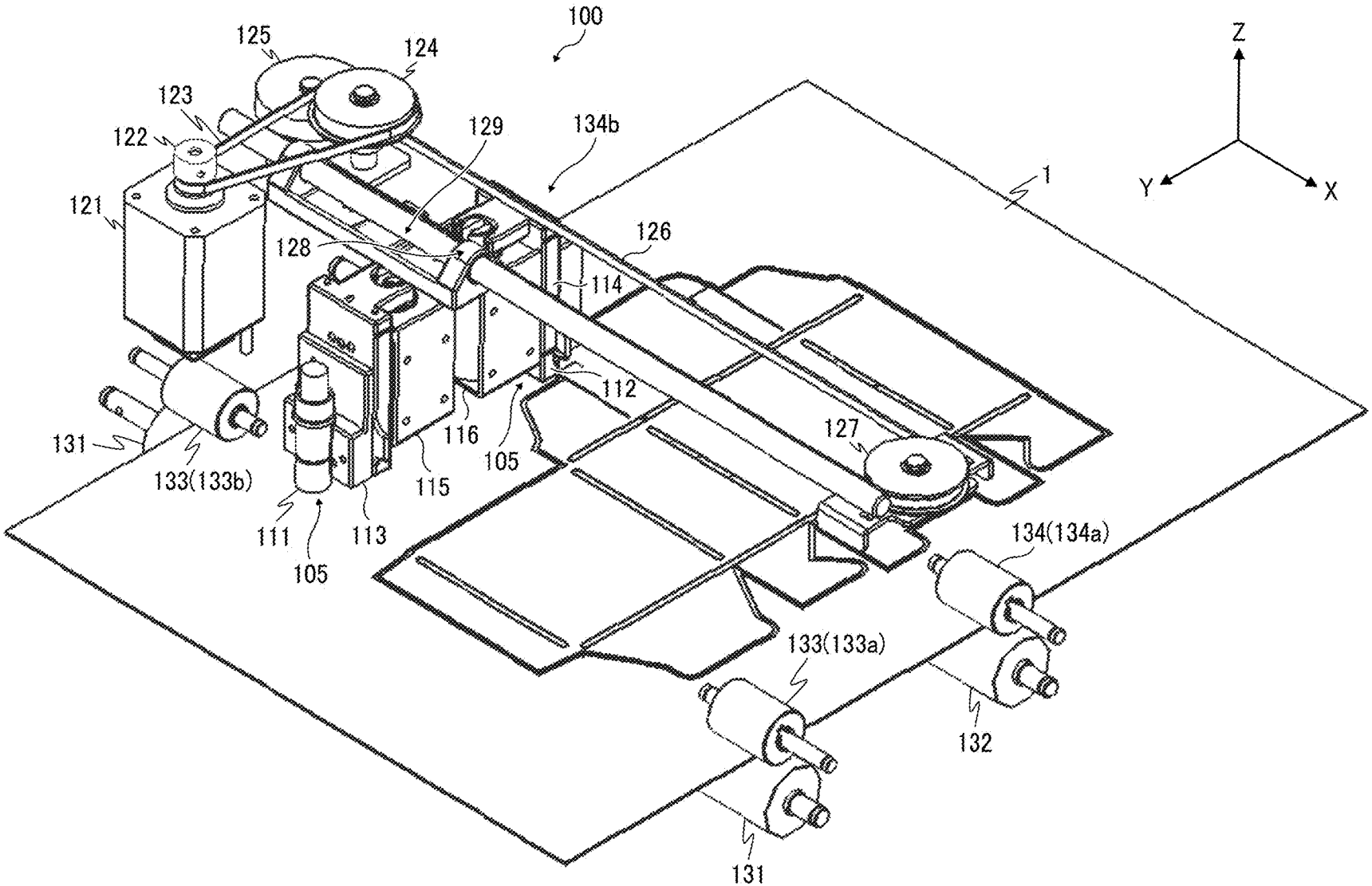
FIG. 3 is a perspective view illustrating the main part of the sheet processing apparatus.
Figure 4:
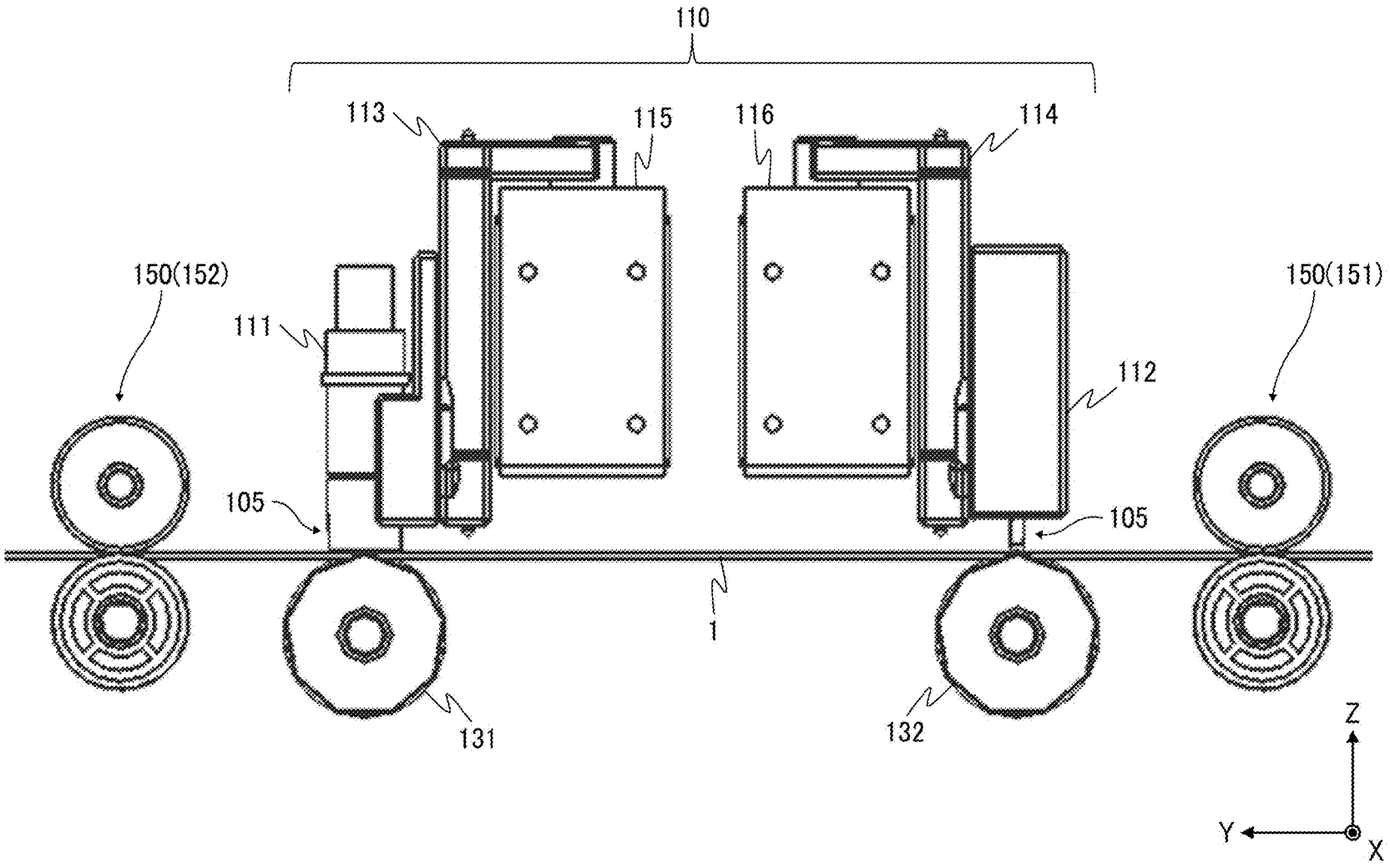
FIG. 4 is an enlarged side view illustrating a part of the main part of the sheet processing apparatus.
Figure 5:
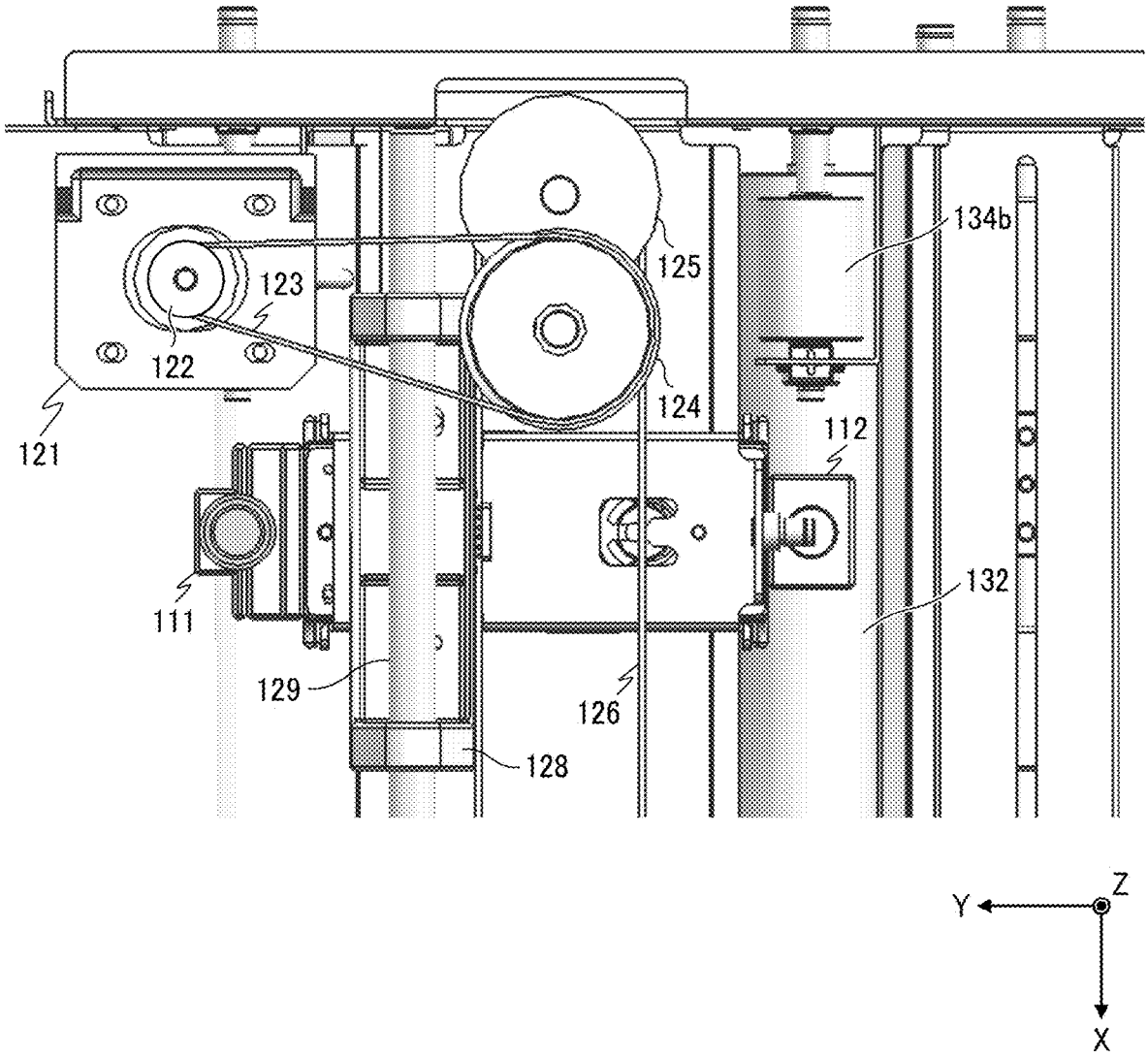
FIG. 5 is an enlarged plan view illustrating a part of the main part of the sheet processing apparatus.
Figure 6:
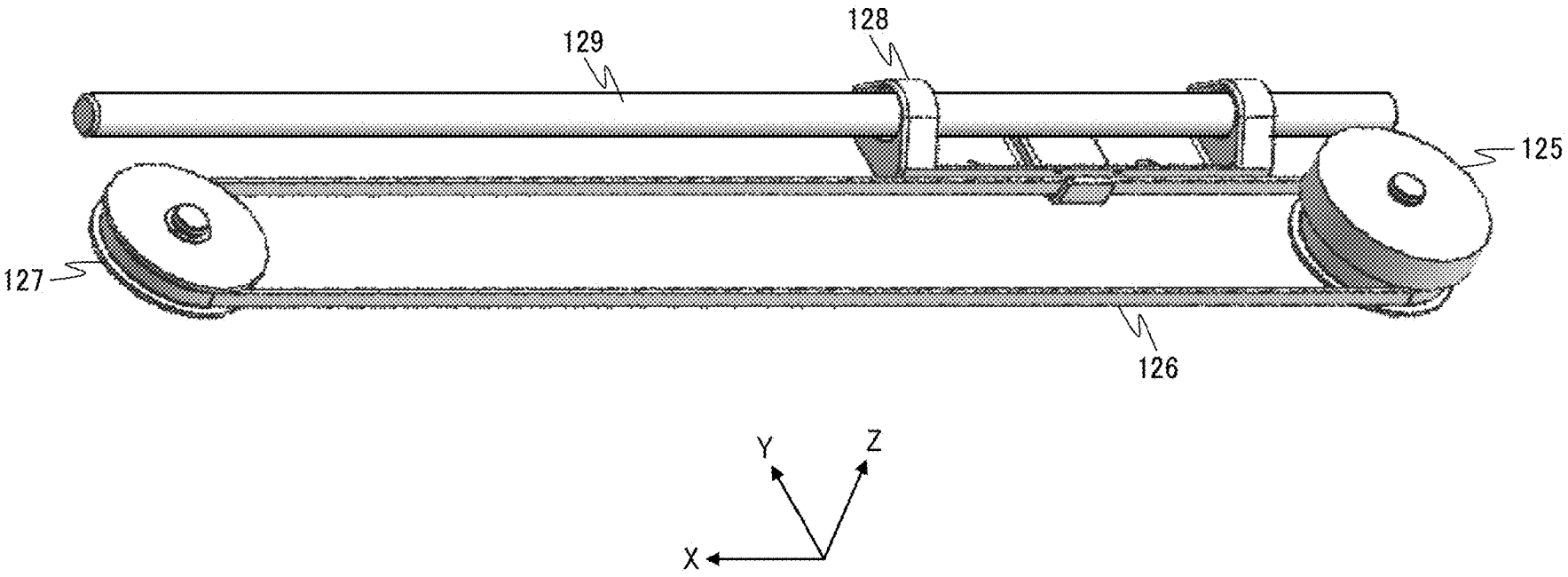
FIG. 6 is an enlarged perspective view illustrating a part of the main part of the sheet processing apparatus.

FIG. 3 is a perspective view illustrating the main part of the internal configuration of the sheet processing apparatus 100. FIG. 4 is an enlarged side view illustrating the processing tools 105 and the tool contact separation device 110 provided in the internal configuration of the sheet processing apparatus 100. FIG. 5 is an enlarged plan view illustrating a drive source of the tool moving device 120 of the sheet processing apparatus 100. FIG. 6 is an enlarged perspective view illustrating a movable holding mechanism of the tool moving device 120 of the sheet processing apparatus 100. Note that the pairs of conveyance rollers 150 are not depicted in FIG. 3.

Configuration of Tool Contact Separation Device 110.

First, a description is given of the configuration of the tool contact separation device 110 with reference to FIGS. 3 and 4.

The tool contact separation device 110 includes a cutter tool 111, a creasing tool 112, a first tool holder 113, a second tool holder 114, a first contact separation actuator 115, and a second contact separation actuator 116. The cutter tool 111 and the creasing tool 112 are included in the processing tools 105.

The cutter tool 111 that functions as a first processing tool is a cutter that contacts the sheet 1 to perform the cut process to the sheet 1. The creasing tool 112 that functions as a second processing tool is a creaser that presses the sheet 1 to perform the crease process to the sheet 1, in other words, to make a crease line or lines in the surface of the sheet 1. The cutter tool 111 is retained above a first facing roller 131 that functions as a tool facing body in the vertical direction and is disposed facing the first facing roller 131. The creasing tool 112 is retained above a second facing roller 132 that functions as a tool facing body in the vertical direction and is disposed facing the second facing roller 132.

The first tool holder 113 couples and retains the first contact separation actuator 115 and the cutter tool 111. The second tool holder 114 couples and retains the second contact separation actuator 116 and the creasing tool 112.

The first contact separation actuator 115 and the second contact separation actuator 116 are coupled with each other by a tool moving member 128. Details of the tool moving member 128 are described below. The tool moving member 128 causes the tool contact separation device 110 to retain the processing tools 105 (that is, the cutter tool 111 and the creasing tool 112) integrally to be movable in the X direction. The first contact separation actuator 115 and the second contact separation actuator 116 are solenoids. By supplying the power to the first contact separation actuator 115 and the second contact separation actuator 116, the processing tools 105 maintain in a pressing state in which the first facing roller 131 and the second facing roller 132 press the sheet 1. Therefore, by controlling the operations of the first contact separation actuator 115 and the second contact separation actuator 116, the cutter tool 111 and the creasing tool 112 are controlled to selectively contact to or separate from the sheet 1. This contact and separation control controls the processing operation to the sheet 1.

As illustrated in FIG. 4, a first pair of conveyance rollers 151 that functions as a conveyance body is disposed upstream from the tool contact separation device 110 that retains the processing tools 105, in the Y direction. In addition, a second pair of conveyance rollers 152 that functions as a conveyance body is disposed downstream from the tool contact separation device 110 that retains the processing tools 105, in the Y direction. The sheet 1 is conveyed in the Y direction by the pairs of conveyance rollers 150 (including the first pair of conveyance rollers 151 and the second pair of conveyance rollers 152). After having been conveyed from the upstream side in the Y direction to the sheet processing apparatus 100, the sheet 1 is held by the first pair of conveyance rollers 151. Due to rotation of the first pair of conveyance rollers 151, the sheet 1 is conveyed below the processing tools 105 to be processed. Then, after the sheet processing is performed to the sheet 1, the sheet 1 is held by the second pair of conveyance rollers 152 to be conveyed out from the sheet processing apparatus 100.

As illustrated in FIG. 3, the first facing roller 131 is disposed facing first gripping rollers 133, each of which functions as a rotary body to rotate along with rotation of the first facing roller 131. To be more specific, one first gripping roller 133 (that is, a first gripping roller 133*a*) is disposed facing the first facing roller 131 on one end side of the first facing roller 131 in the X direction and another first gripping roller 133 (that is, a first gripping roller 133*b*) is disposed facing the first facing roller 131 on the opposite end side of the first facing roller 131 in the X direction. Further, a second facing roller 132 is disposed facing each second gripping roller 134, each of which rotates along with rotation of the second facing roller 132. To be more specific, one second gripping roller 134 (that is, a second gripping roller 134*a*) is disposed facing the second facing roller 132 on one end side of the second facing roller 132 in the X direction and another second gripping roller 134 (that is, a second gripping roller 134*b*) is disposed facing the second facing roller 132 on the opposite end side of the second facing roller 132 in the X direction. The sheet 1 is gripped by the first facing roller 131 and the first gripping roller 133, both as conveyance bodies, and by the second facing roller 132 and the second gripping roller 134, both as conveyance bodies, so that the sheet 1 is reciprocally moved (conveyed) in the Y direction. That is, when the sheet 1 is processed, the sheet 1 is conveyed by the first facing roller 131 and the first gripping roller 133 and by the second facing roller 132 and the second gripping roller 134, in addition to, by the first pair of conveyance rollers 151 and the second pair of conveyance rollers 152.

Configuration of Tool Moving Device 120.

Next, a description is given of the configuration of the tool moving device 120, with reference to FIGS. 3, 5, and 6.

The tool moving device 120 includes an X-axis drive motor 121, an output timing pulley 122, a first timing belt 123, a reduction timing pulley 124, a first tool moving pulley 125, a second timing belt 126, a second tool moving pulley 127, the tool moving member 128, and a tool moving guide shaft 129.

The X-axis drive motor 121 is a drive source that is rotatable in both the forward direction and the reverse direction to move the tool contact separation device 110 that retains the cutter tool 111 and the creasing tool 112, in a direction intersecting the conveyance direction of the sheet 1 (the Y direction). The rotary shaft of the X-axis drive motor 121 is coupled with the reduction timing pulley 124 from the output timing pulley 122 via the first timing belt 123.

The reduction timing pulley 124 is in contact with the first tool moving pulley 125 via a gear portion that is molded as a single component. Accordingly, as the X-axis drive motor 121 drives to rotate the reduction timing pulley 124, the first tool moving pulley 125 rotates via the gear portion.

As illustrated in FIGS. 5 and 6, the first tool moving pulley 125 and the second tool moving pulley 127 as a pair together are coupled by the second timing belt 126. Therefore, the second timing belt 126 that is wound around the first tool moving pulley 125 and the second tool moving pulley 127 rotates along with rotation of the first tool moving pulley 125.

The tool moving member 128 holds the second timing belt 126 to fix at a given position of the second timing belt 126. Accordingly, as the second timing belt 126 rotates between the first tool moving pulley 125 and the second tool moving pulley 127, the tool moving member 128 also moves along with the rotation of the second timing belt 126. The tool moving guide shaft 129 is inserted through the tool moving member 128. The tool moving guide shaft 129 is disposed extending in the X direction and both end portions of the tool moving guide shaft 129 are fixed to a housing of the sheet processing apparatus 100. Therefore, along with rotation of the second timing belt 126, that is, along with rotation of the X-axis drive motor 121, the tool moving member 128 is guided by the tool moving guide shaft 129 to move in the X direction alone. Consequently, as the X-axis drive motor 121 rotates in the forward direction and the reverse direction, the tool contact separation device 110 that is coupled with and fixed to the tool moving member 128 reciprocally moves in the direction (the X direction) intersecting the conveyance direction of the sheet 1. Accordingly, the processing tools 105 are held to be reciprocally movable in the direction (the X direction) intersecting the conveyance direction of the sheet 1.

Configuration of Tool Facing Device 130.

Next, a description is given of the configuration of the tool facing device 130, with reference to FIG. 3.

The tool facing device 130 includes the first facing roller 131, the second facing roller 132, the first gripping rollers 133 (that is, the first gripping roller 133*a* and the first gripping roller 133*b*), and the second gripping rollers 134 (that is, the second gripping roller 134*a* and the second gripping roller 134*b*). The first facing roller 131 and the second facing roller 132 are rotary members that rotate in both directions, which are the forward direction and the reverse direction, by a drive source such as an electric motor. The first facing roller 131 and the second facing roller 132 rotate (move) to convey the sheet 1 in synchrony with conveyance of the sheet 1 by the first pair of conveyance rollers 151 and the second pair of conveyance rollers 152. That is, the first facing roller 131, the second facing roller 32, the first gripping rollers 133, and the second gripping rollers 134 rotate together with the first pair of conveyance rollers 151 and the second pair of conveyance rollers 152. The first facing roller 131 and the second facing roller 132 are also drive rollers. The first gripping rollers 133 and the second gripping rollers 134 are driven rollers that rotate along with rotations of the drive rollers.

Each of the first gripping rollers 133 is pressed (biased) by a biasing member in the −Z direction so as to be pressed against the first facing roller 131. Each of the second gripping rollers 134 is pressed (biased) by a biasing member in the −Z direction so as to be pressed against the second facing roller 132. Therefore, the first facing roller 131 and the first gripping rollers 133 (that is, the first gripping roller 133*a* and the first gripping roller 133*b*) grip the sheet 1 while the sheet 1 is being processed. Further, the second facing roller 132 and the second gripping rollers 134 (that is, the second gripping roller 134*a* and the second gripping roller 134*b*) also grip the sheet 1 while the sheet 1 is being processed. Note that, in FIG. 3, a part of the second gripping rollers 134 (that is, the second gripping roller 134*b*) is hidden behind the tool contact separation device 110, and therefore the second gripping roller 134*b* is not depicted in FIG. 3.

When processing the sheet 1, as the first facing roller 131 and the second facing roller 132, both of which function as drive rollers, rotate in the forward and reverse rotations, the sheet 1 in the processing is reciprocally conveyed in the Y direction. That is, the tool facing device 130 is a conveying device that functions as a sheet conveyor that reciprocally conveys the sheet 1 in the Y direction. Due to the control of rotation of the tool facing device 130, the sheet 1 is reciprocally conveyed between the cutter tool 111 and the first facing roller 131 and between the creasing tool 112 and the second facing roller 132.

In the present embodiment, the pairs of conveyance rollers 150, various rotary members, and the X-axis drive motor 121 are based on stepping motors. However, as long as the above-described operations are performed, the type of a drive source is not limited. Further, the first contact separation actuator 115 and the second contact separation actuator 116 are based on respective solenoids. However, as long as the above-described operations are performed, the type of a drive source is not limited.

Note that the present embodiment provides the configuration in which the processing tools 105 and the tool contact separation mechanism (the tool contact separation device 110) are moved in the width direction of the sheet 1 by the tool process moving mechanism (the tool moving device 120). However, the sheet processing apparatus according to this disclosure is not limited to this configuration. For example, the processing tools 105 may contact to and separate from the tool process moving mechanism (the tool moving device 120) by the tool contact separation mechanism. Alternatively, a mechanism may move the processing tools 105 alone in the width direction of the sheet 1 and another mechanism may cause the processing tools 105 alone to contact to and separate from the sheet 1.

Control Configuration of Sheet Processing Apparatus 100.

Figure 7:
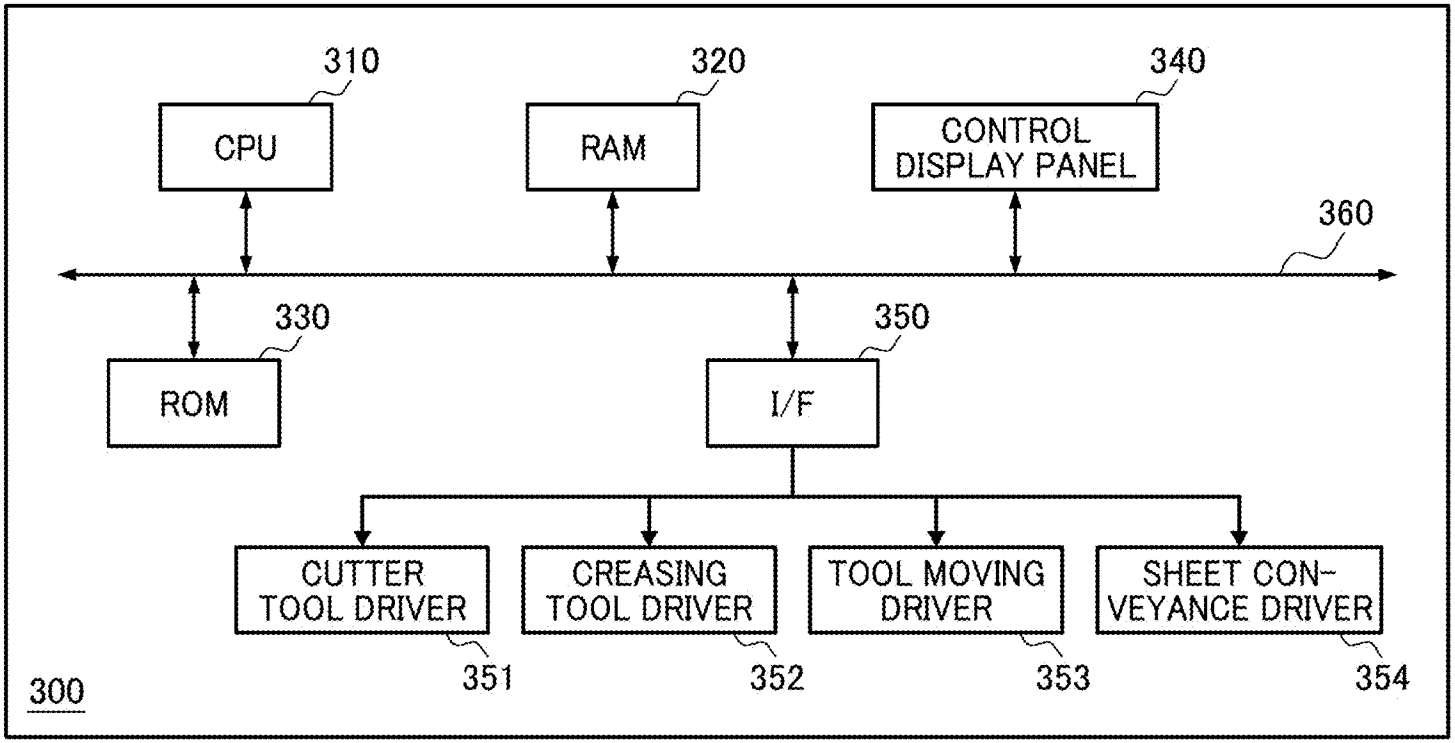
FIG. 7 is a block diagram illustrating a control configuration of the sheet processing apparatus.
Figure 8:
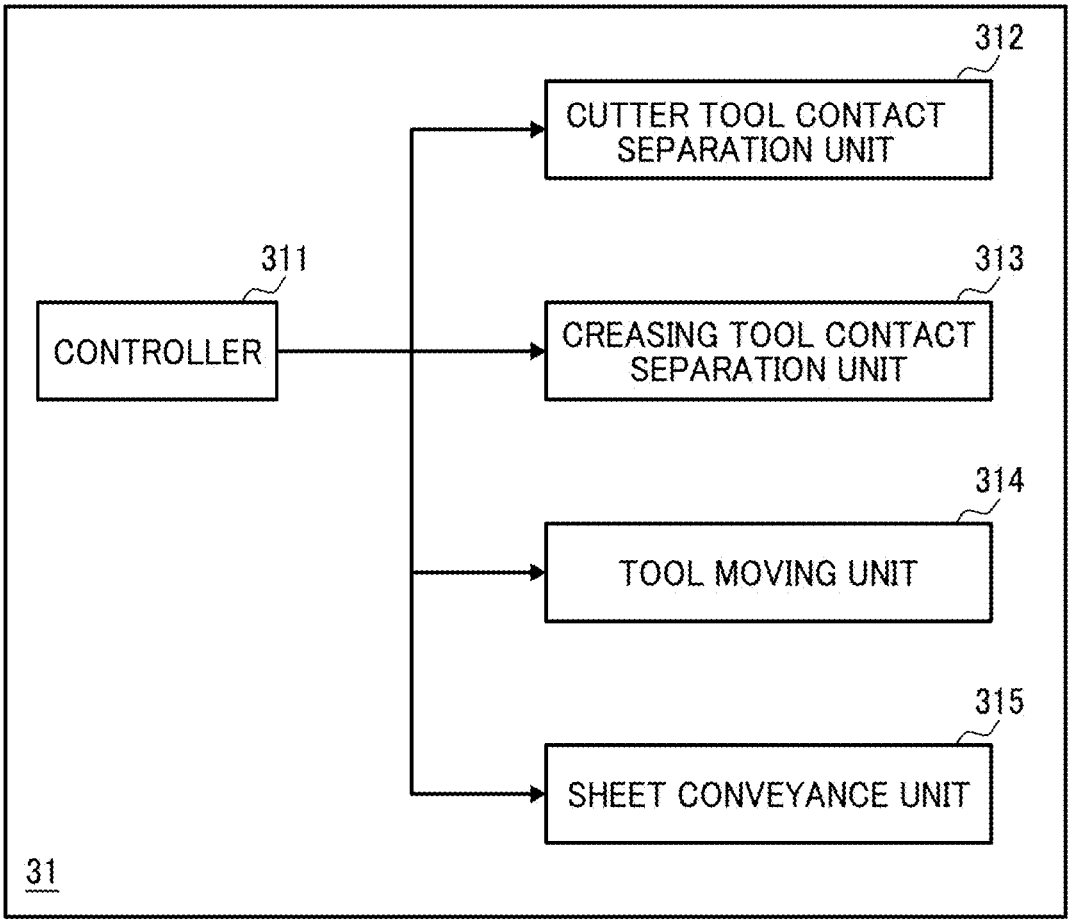
FIG. 8 is a functional block diagram illustrating a functional configuration of the sheet processing apparatus.

Next, a description is given of the control configuration of the sheet processing apparatus 100 according to the present embodiment of this disclosure, with reference to FIGS. 7 and 8.

FIG. 7 is a block diagram illustrating a hardware configuration of the control system of the sheet processing apparatus 100. FIG. 8 is a block diagram illustrating a functional configuration of the control system of the sheet processing apparatus 100.

As illustrated in FIG. 7, the sheet processing apparatus 100 includes the control device 300. The control device 300 has the same configuration as generally known information processing devices. That is, in the control device 300 according to the present embodiment of this disclosure, a central processing unit (CPU) 310, a random access memory (RAM) 320, a read only memory (ROM) 330, a control display panel 340, and an interface (I/F) 350 are connected via a bus 360. A cutter tool driver 351, a creasing tool driver 352, a tool moving driver 353, and a sheet conveyance driver 354 are connected to the I/F 350.

The CPU 310 is a calculation unit and controls the operation of the entire information processing device. The RAM 320 is a volatile memory capable of high-speed reading and writing of information. The RAM 320 is used as a work area when the CPU 310 processes information. The ROM 330 is a read-only non-volatile memory to store firmware, control programs, and the like. The control display panel 340 is provided with a display screen that displays information to notify a user of the operation status of the sheet processing apparatus 100, for example. The control display panel 340 also provides an input interface via which a user inputs a set value to be used for the control.

The I/F 350 transmits a control signal generated as a result of calculation of the CPU 310, to a specified driver, so that the driver causes a corresponding unit to perform each designated function. The cutter tool driver 351 controls the contact and separation operations in which the cutter tool 111 selectively contacts to and separates from the sheet 1. The creasing tool driver 352 controls the contact and separation operations in which the creasing tool 112 selectively contacts to and separates from the sheet 1. The tool moving driver 353 controls rotational movement of the X-axis drive motor 121 in the forward and reverse directions. The sheet conveyance driver 354 controls respective rotational operations of the first facing roller 131 and the second facing roller 132 and rotational operations of the pairs of conveyance rollers 150.

Functional Configuration of Sheet Processing Apparatus 100.

In the hardware configuration described above, the CPU 310 performs calculation according to the program stored in the ROM 330, thereby constructing a software controller. A combination of the software controller thus constructed and the hardware constructs functional blocks that implement functions of the sheet processing apparatus 100 according to the present embodiment is formed (see FIG. 8).

As illustrated in FIG. 8, a control unit 31 is achieved by the control device 300 of the sheet processing apparatus 100 and includes a controller 311 that controls the whole operations of the sheet processing apparatus 100, a cutter tool contact separation unit 312, a creasing tool contact separation unit 313, a tool moving unit 314, and a sheet conveyance unit 315.

The tool moving unit 314 controls the processing tools 105 along the X-axis (the X direction), specifically, the moving direction, the moving amount, the moving speed, and timings of start and stop of movements of the processing tools 105 along the X-axis (the X direction).

The sheet conveyance unit 315 controls the sheet 1 along the Y-axis (the Y direction), specifically, the moving direction (the conveyance direction), the moving amount, the moving speed, and timings of start and stop of movements of the sheet 1 along the Y-axis (the Y direction).

The cutter tool contact separation unit 312 causes the cutter tool 111 to contact, press, or separate from the sheet 1 at a given timing. The creasing tool contact separation unit 313 causes the creasing tool 112 to contact, press, or separate from the sheet 1 at a given timing.

The control unit 31 including a control program executed by the CPU 310 configures the above-described function units, so that the function units perform the control operations. By performing these control operations, the cutter tool 111 and the creasing tool 112 are moved while conveying the sheet 1, so as to selectively perform the contact and separation operations. By performing the contact and separation operations, while a given trajectory in the two-dimensional area is drawn on the sheet 1, the crease process is performed to the sheet 1 at a desired position or positions and the cut process is performed to cut the sheet 1 to a desired shape.

The first facing roller 131 that includes a tool opposing face (tool facing portion) to face the cutter tool 111 and the second facing roller 132 that includes the tool opposing face (tool facing portion) to face the creasing tool 112 are rollers, each of which including an elastic body represented by silicon rubber and ethylene propylene (EP) rubber. That is, the tool opposing face of the first facing roller 131 and the tool opposing face of the second facing roller 132 are made of elastic bodies.

Here, a detailed description is given of the operations of the sheet processing apparatus 100.

When the processing tools 105 performs sheet processing (first processing) to the sheet 1 in a direction orthogonal to the conveyance direction of the sheet 1, the first facing roller 131 and the second facing roller 132 are held not to rotate, in other words, held not to move the first facing roller 131 and the second facing roller 132. In other words, the tool facing device 130 including the first facing roller 131 and the second facing roller 132 is immovable when a moving direction of the processing tools 105 relative to the sheet 1 is orthogonal to conveyance direction of the sheet 1.

When sheet processing (second processing) is performed to the sheet 1 in a direction other than the direction orthogonal to the conveyance direction of the sheet 1, the first facing roller 131 and the second facing roller 132 rotate in the conveyance direction of the sheet 1. By performing the operation controls as described above, the positions (portions) of the tool opposing faces of the first facing roller 131 and the second facing roller 132, at which the processing tools 105 are received, may be changed according to the conveyance direction of the sheet 1. As a result, when sheet processing is performed to the sheet 1 in the width direction while changing the positions of tool opposing faces of the first facing roller 131 and the second facing roller 132, the tool opposing faces are held not to move (in other words, held to be immovable) so that stable processing is performed.

In a known sheet processing apparatus, for example, a facing member is provided at a given position so as not to deviate from the processing tool. Therefore, the opposing position (the opposing face) of the facing member facing the processing tool is likely to be cut or pressed by the processing tool each time the processing is performed. Due to the cutting or pressing by the pressing tool, the facing member deteriorates at the given position (the opposing position) alone. As a result, the opposing face of the facing member at the opposing position is broken or the elasticity of the facing member deteriorates. The breakage of the facing member or the deterioration in the elasticity of the facing member causes deterioration in function as the facing member. If the elasticity of the facing member deteriorates, it is difficult to receive the sheet properly in the processing, which may adversely affect on the processing accuracy with respect to the sheet.

Regrading the facing member provided to face the processing tool, the known sheet processing apparatus provides a known technique in which a facing member is rotated according to the number of processes to shift the position (the opposing position) to receive the processing tool, so as to enhance the durability of the facing member.

This technique of the known sheet processing apparatus is used to move the opposing face of a roller-shaped facing member, according to the number of movements of the cutter tool in a direction orthogonal to a conveyance direction of a sheet. If the roller-shaped facing member is applied to the known sheet processing apparatus, when a given two-dimensional processing is performed to a sheet, friction is generated between the elastic member and the sheet while the sheet is being conveyed, and the friction turns to be a cause to prevent movement of the sheet. Accordingly, if the technique is applied to the facing member, a relative movement of the sheet to the processing tool is hindered, and therefore the processing accuracy may deteriorate.

Further, in the technique, since the processing tool is received at the same opposing position for a certain number of times, the elastic member including the opposing face still have a problem to enhance prevention of deterioration of the elastic member.

In a case in which the tool opposing faces of the first facing roller 131 and the second facing roller 132 of the sheet processing apparatus 100 according to the present embodiment are not moved in the above-described manner, the same portions of the first facing roller 131 and the second facing roller 132 (specified portions of the first facing roller 131 and the second facing roller 132) are continuously engaged with the cutter tool 111 and the creasing tool 112. As a result, "settling" such as wear or deformation of the specific portions of the first facing roller 131 and the second facing roller 132 advances quickly, thereby deteriorating the durability of the first facing roller 131 and the second facing roller 132.

In this respect, with the sheet processing apparatus 100 according to the present embodiment, when the sheet processing (the second processing) is performed to the sheet 1 in the direction other than the direction orthogonal to the conveyance direction of the sheet 1, that is, when the sheet processing is performed to the sheet 1 in directions including the conveyance direction of the sheet 1, at least the first facing roller 131 facing the cutter tool 111 rotates so that the tool opposing face moves around at the same speed as the conveying speed of the sheet 1. In other words, when the moving direction of the tool facing device 130 including the first facing roller 131 is directed other than the direction orthogonal to the conveyance direction of the sheet 1, the tool facing device 130 moves in synchrony with conveyance of the sheet 1.

In a case in which the first facing roller 131 does not rotate in synchrony with the conveying speed of the sheet 1, since the sheet 1 and the first facing roller 131 contact each other over the entire region in the width direction of the sheet 1, the first facing roller 131 hinders conveyance of the sheet 1. When conveyance of the sheet 1 is hindered, the sheet conveyance force of the sheet 1 needs to be increased, which results in an increase in size of the whole sheet processing apparatus 100 or allowance of variation of the conveying speed of the sheet 1. When the conveyance speed of the sheet 1 varies, the processing accuracy also varies, and therefore the size of the whole sheet processing apparatus 100 has to be increased. In this respect, with the sheet processing apparatus 100 according to the present embodiment, the first facing roller 131 rotates in synchrony with movement of the sheet 1, thereby assisting conveyance of the sheet 1 in the sheet processing and achieving a reduction in size of the sheet processing apparatus 100 and the highly accurate sheet processing of the sheet 1 with a given two-dimensional trajectory.

Detailed Description of Embodiment of Creasing Tool 112.

Figure 9:
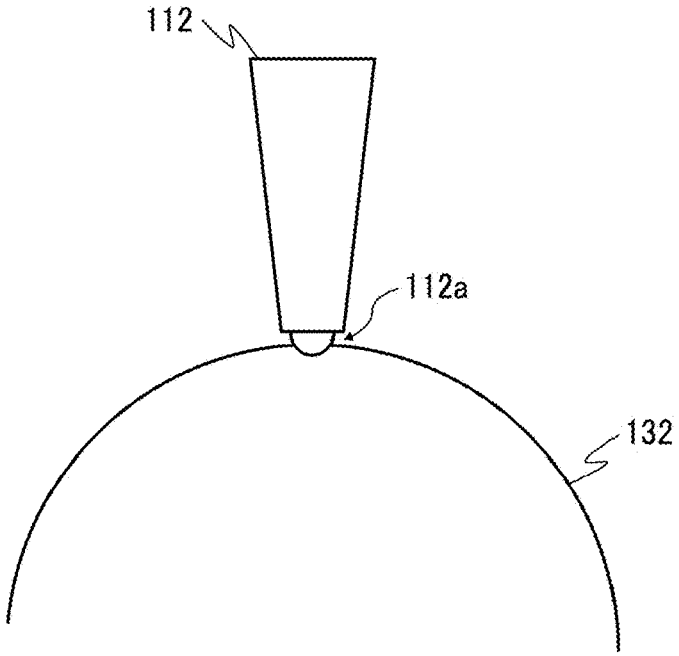
FIG. 9 is an enlarged side view illustrating a part of a processing tool provided in the sheet processing apparatus.

Next, a description is given of the detailed configuration of the creasing tool 112, with reference to FIG. 9.

FIG. 9 is an enlarged side view illustrating the tip of the creasing tool 112 of the sheet processing apparatus 100.

A tip member 112*a* is attached to the tip of the creasing tool 112. The tip member 112*a* is a member having a spherical surface and is held at the tip of the creasing tool 112. The tip member 112*a* contacts and presses the second facing roller 132. The surface of the second facing roller 132 has elasticity. Therefore, when the second facing roller 132 is pressed by the tip member 112a, the surface of the second facing roller 132 is recessed.

While the sheet 1 is held between the tip member 112*a* of the creasing tool 112 and the second facing roller 132, the creasing tool 112 moves to the sheet 1 relatively in the two-dimensional direction. By so doing, the crease process providing the trajectory including given free-form curves is performed to the sheet 1. In the crease process, the tip member 112*a* moves in a direction with low friction in accordance with a relative moving direction of the sheet 1, so that the friction of movement of the creasing tool 112 is reduced when the sheet processing (the crease process) is performed by the creasing tool 112.

Note that the tip member 112*a* is not limited to a member having a spherical surface but may be a spherical tip member such as the tip of a ballpoint pen that is a rotatable tip freely rotatable in given directions. In this case, since the tip member 112*a* rotates in the direction in accordance with the relative moving direction of the sheet 1 when the crease process is performed to the sheet 1, the creasing tool 112 moves with lower friction. Accordingly, in a case in which the tip member 112*a* is formed of a ball-shaped member, the friction of movement of the creasing tool 112 generated when the crease process is performed by the creasing tool 112 is further reduced.

Further, a pencil or a pen tool such as a ballpoint pen using ink may be used as the tip member 112*a*. In this case, in the crease process using the creasing tool 112, while the tip member 112*a* of the creasing tool 112 moves in the direction in accordance with the relative moving direction of the sheet 1, the creasing tool 112 draws (forms) an image including free-form curves or visible lines such as ruled lines on the sheet 1 with a given trajectory.

Detailed Embodiment of Cutter Tool 111.

Figure 10:
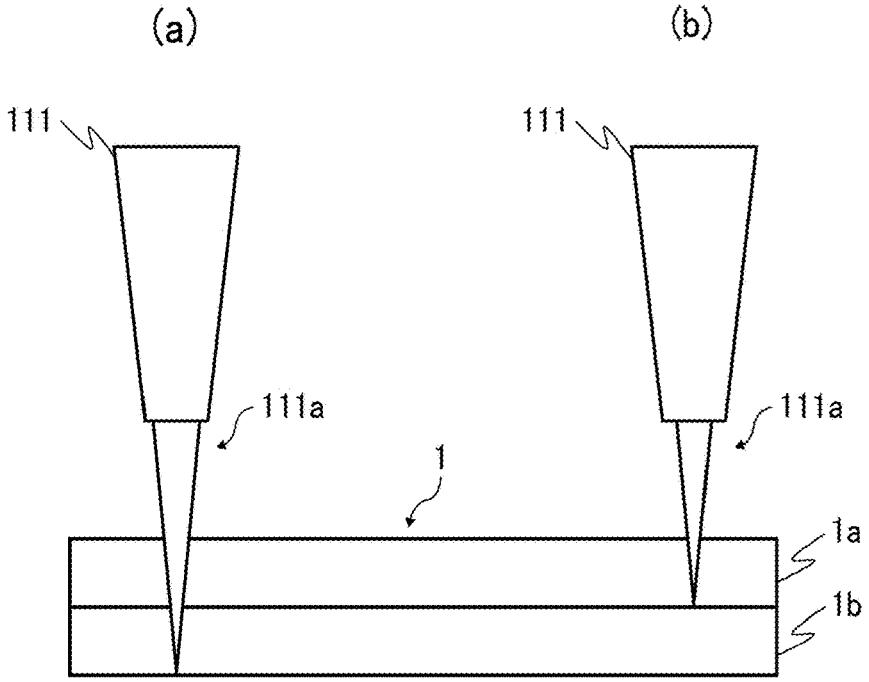
FIG. 10 including FIGS. 10(*a*) and 10(*b*) is an enlarged side view illustrating a part of another processing tool provided in the sheet processing apparatus, where FIG. 10(*a*) illustrates an enlarged side view of a tip of a cutter tool when the cutter tool performs through cutting, and FIG. 10(*b*) illustrates an enlarged side view of the tip of the cutter tool when the cutter tool performs half cutting.

Next, a description is given of the detailed configuration of the cutter tool 111, with reference to FIG. 10.

FIG. 10 including FIGS. 10(*a*) and 10(*b*) is an enlarged side view of the tip of the cutter tool 111. Specifically, FIG. 10(*a*) illustrates an enlarged side view of the tip of the cutter tool 111 when the cutter tool 111 performs through cutting, and FIG. 10(*b*) illustrates an enlarged side view of the tip of the cutter tool 111 when the cutter tool 111 performs half cutting.

A cutter blade 111*a* is held at the tip of the cutter tool 111. The cutter blade 111*a* is held so that the amount of protrusion may be changed. The cutter tool contact separation unit 312 controls the amount of protrusion of the cutter blade 111*a* in the thickness direction of the sheet 1. In other words, the cutter tool 111 cuts the sheet 1 in the thickness direction of the sheet 1. For example, when the sheet 1 has layers including a releasable seal layer la and a mount layer 1*b*, in a case in which the tip of the cutter blade 111*a* of the cutter tool 111 is protruded by the amount corresponding to the thickness of the releasable seal layer 1*a*, the cutter tool 111 cuts the releasable seal layer la alone, as illustrated in FIG. 10(*b*). In other words, the cutter tool 111 cuts a part of the sheet 1 in the thickness direction of the sheet 1.

Further, in a case in which the tip of the cutter blade 111*a* of the cutter tool 111 is protruded by the amount corresponding to the sum of the thickness of the releasable seal layer 1*a* and the thickness of the mount layer 1*b*, the cutter tool 111 cuts the entire sheet 1 in the thickness direction of the sheet 1, as illustrated in FIG. 10(*a*).

In addition, the amount of protrusion of the tip of the cutter blade 111*a* is controlled intermittently between the amount corresponding to the thickness of the releasable seal layer 1*a* and the amount corresponding to the sum of the thickness of the releasable seal layer 1*a* and the thickness of the mount layer 1*b*, so as to provide a cutting portion and a non-cutting portion intermittently to the sheet 1. That is, the cutter tool 111 provides a cutting portion and a non-cutting portion intermittently to the sheet 1 in the thickness direction of the sheet 1.

Accordingly, when the cutter tool 111 is used when performing sheet processing to the sheet 1, while the cutter blade 111*a* moves in a direction in accordance with the relative moving direction of the sheet 1, the cutter tool 111 performs half cutting or through cutting, including free-form curves with a given trajectory, and perforation.

Embodiment of Image Forming System.

Figure 11:
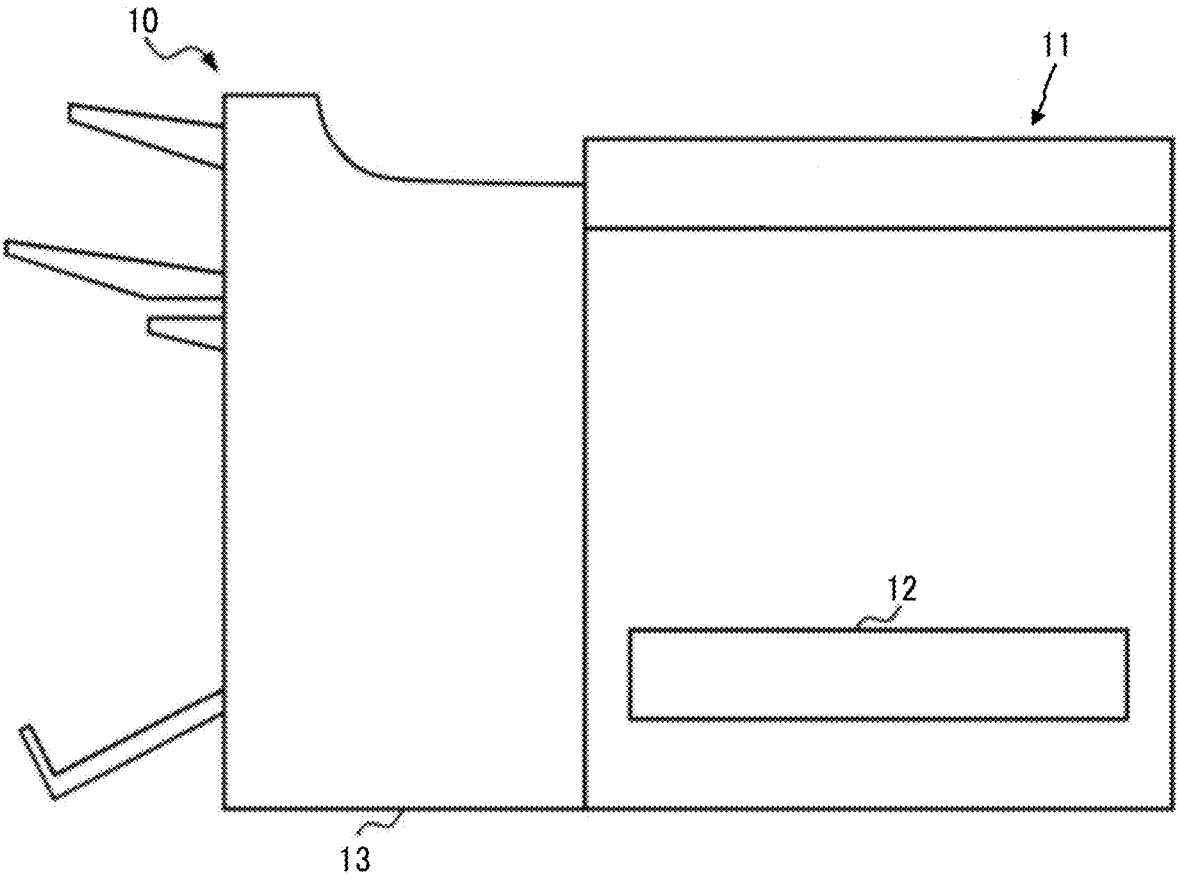
FIG. 11 is a side view illustrating an image forming system according to an embodiment of this disclosure.

Next, a description is given of an image forming system according to an embodiment of this disclosure, with reference to FIG. 11.

FIG. 11 is a side view illustrating the external appearance of an image forming system 10 according to an embodiment of this disclosure.

The sheet processing apparatus 100 described above is applicable as a stand-alone apparatus but may be included in the image forming system 10.

The image forming system 10 includes an image forming apparatus 11 and a post-processing device 13. The image forming apparatus 11 includes a media feeding device 12. The image forming apparatus 11 forms a given image on a sheet 1 fed from the media feeding device 12 and conveys the sheet 1 toward the post-processing device 13. Note that the image forming apparatus 11 is an apparatus that attaches material (such as liquid ink and toner) to form an image onto the sheet 1 that functions as a recording medium and that relates to, for example, electrophotographic printing, inkjet printing, and screen printing.

In a case in which the sheet processing apparatus 100 is provided in the post-processing device 13, after the image forming apparatus 11 forms an image on the sheet 1, the sheet processing apparatus 100 performs the first processing and the second processing, as described above, to convey the processed sheet 1.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a sheet conveyor including pairs of conveyance rollers configured to convey a sheet at a conveyance speed in a conveyance direction;

a processing tool configured to perform processing to the sheet, the processing tool being between the pairs of conveyance rollers in the conveyance direction of the sheet;

a tool contact separation device configured to contact and separate the processing tool to the sheet;

a tool moving device configured to move the processing tool in a direction intersecting the conveyance direction of the sheet; and a tool facing device including a facing roller having a tool facing portion disposed at a position facing the processing tool with the sheet interposed therebetween, the facing roller being drivable by a drive source; and a controller configured to determine whether a moving direction of the processing tool is orthogonal to the conveyance direction of the sheet, and to control the drive source to, set the facing roller to a first state by instructing the drive source to immobilize the facing roller such that the tool facing portion is immovable, when the controller determines that the moving direction of the processing tool with respect to the sheet is orthogonal to the conveyance direction of the sheet, and set the facing roller to a second state by instructing the drive source to rotate the facing roller in synchrony with conveyance of the sheet by the pairs of conveyance rollers such that the tool facing portion rotates at a same speed as the conveyance speed of the sheet, when the controller determines that the moving direction of the processing tool with respect to the sheet is not orthogonal to the conveyance direction of the sheet.

2. The sheet processing apparatus according to claim 1, wherein the tool facing device is configured to move the tool facing portion in synchrony with conveyance of the sheet when the moving direction of the processing tool with respect to the sheet is not orthogonal to the conveyance direction of the sheet.

3. The sheet processing apparatus according to claim 1, wherein the tool facing portion includes an elastic body.

4. The sheet processing apparatus according to claim 1, further comprising:

a rotary body disposed facing the tool facing portion.

5. The sheet processing apparatus according to claim 4, wherein the rotary body is configured to convey the sheet in the conveyance direction of the sheet.

6. The sheet processing apparatus according to claim 5, wherein the rotary body is configured to rotate together with the sheet conveyor.

7. The sheet processing apparatus according to claim 1, wherein the processing tool includes at least one of:

a creaser configured to make a crease in a surface of the sheet; and a cutter configured to cut the sheet.

8. The sheet processing apparatus according to claim 7, wherein the creaser includes a spherical tip.

9. The sheet processing apparatus according to claim 7, wherein the creaser includes a rotatable tip.

10. The sheet processing apparatus according to claim 7, wherein the creaser is configured to form a visible line on the sheet.

11. The sheet processing apparatus according to claim 7, wherein the cutter is configured to cut the sheet in a thickness direction of the sheet.

12. The sheet processing apparatus according to claim 7, wherein the cutter is configured to cut a part of the sheet in a thickness direction of the sheet.

13. The sheet processing apparatus according to claim 7, wherein the cutter is configured to form a cutting portion and a non-cutting portion intermittently to the sheet in a thickness direction of the sheet.

14. The sheet processing apparatus according to claim 1, wherein the processing tool includes:

a creaser disposed facing the tool facing device, the creaser configured to make a crease in a surface of the sheet; and a cutter disposed facing the tool facing device, the cutter configured to cut the sheet.

15. An image forming system comprising:

an image forming apparatus configured to form an image on a sheet; and the sheet processing apparatus according to claim 1, configured to process the sheet with the image formed by the image forming apparatus.

* * * * *